United States Patent [19]

Kulikowski

[11] 4,344,760

[45] Aug. 17, 1982

[54] MARINE PROPULSION SYSTEM

[76] Inventor: Andrzej S. Kulikowski, 35-221 Ormskirk Ave., Toronto, Ontario, Canada, M6S 1A8

[21] Appl. No.: 66,674

[22] Filed: Aug. 15, 1979

[51] Int. Cl.[3] ..... B63H 21/00; B63H 23/10

[52] U.S. Cl. ..... 440/3; 60/716; 60/718; 74/661; 74/665 GB; 440/75; 440/79

[58] Field of Search ..... 440/3, 4, 49, 75, 79; 74/665 M, 665 GB, 661; 60/716, 718; 416/170 R

[56] References Cited

U.S. PATENT DOCUMENTS

| | | | |
|---|---|---|---|
| 1,152,567 | 9/1915 | Spear | 60/718 |
| 2,155,434 | 4/1939 | Marsh | 74/661 |
| 3,112,728 | 12/1963 | Krause | 440/75 |
| 3,113,549 | 12/1963 | Frank et al. | 440/79 |
| 3,304,906 | 2/1967 | Nace | 440/4 |
| 3,422,790 | 1/1969 | Connell | 440/4 |

*Primary Examiner*—Charles E. Frankfort
*Attorney, Agent, or Firm*—Bruns & Jenney

[57] ABSTRACT

A marine propulsion system for a cruising boat or the like which utilizes two engines, one of the engines having substantially more power than the other. The propulsion system provides for twin propellers and propeller shafts and either engine (but not both) can be made to drive the twin shafts. The engines are positioned in line with one another on the fore and aft center line of the boat and the drive shafts of the two engines extend into a common transmission assembly. Clutches in the transmission assembly permit either one of the engine drive shafts to be drivingly connected to an athwartships shaft the ends of which are respectively connected through transmission gear case units to the propeller shafts. The propeller shafts are laterally spaced from one another and are parallel to the center line of the boat. With this arrangement, the more powerful engine can be used for high speed cruising or when severe weather conditions dictate and the less powerful engine can be used for slow speeds and economical long distance cruising.

8 Claims, 3 Drawing Figures

MARINE PROPULSION SYSTEM

BACKGROUND OF THE INVENTION

This invention relates generally to marine propulsion systems, and has particular reference to a novel dual engine, twin propeller marine propulsion system for cruising boats which is considerably more efficient than conventional twin engine power plants.

As is well understood by those familiar with ship and boat handling, a twin engine, twin propeller propulsion system has certain advantages over a single engine system. Thus, the twin engine system usually provides greater power and is more reliable; if one engine fails there is another one to fall back on. The twin engine system also makes a ship or boat more maneuverable since by having one propeller turning in the forward direction and the other in the reverse direction the boat can be "twisted", i.e. turned with a very short turning radius.

In conventional twin engine propulsion systems, the engines are mounted side by side and are the same make and power, one of the engines having a left hand turning propeller and the other a right hand turning propeller. Unfortunately, in these systems there is a great deal of power wasted because, due to basic combustion engine design, optimum efficiency is obtained only in a relatively narrow R.P.M. band. Also, because cruising boats must be designed and powered to safely meet severe sea and weather conditions, the engines have far more power than is normally needed. Oversized engines in fast planing hull type boats also waste power because the boats travel at slow displacement and semidisplacement speeds most of the time. When very powerful engines are used to propel boats at slow speeds not only is there poor fuel economy but maintenance problems increase, e.g. spark plugs foul, cylinders and valves carbonize, etc.

In efforts to solve some of the problems noted above, various other types of propulsion systems have been proposed. One of these provides for a single inboard engine with a power generator nearby that can be manually connected to the propeller shaft if the main engine fails. In Europe a system has been used in which a small engine with its own transmission and propeller is mounted next to a centrally located main engine. Again, the small engine is only for an emergency as its use is not efficient. Another system that has been proposed is one in which identical twin engines are coupled to a single propeller. This provides insurance in the event that one engine fails but the system has none of the other advantages of a twin engine, twin propeller system and is quite inefficient in operation.

The closest prior patent known to the applicant is U.S. Pat. No. 1,019,283 to E. Surcouf. The Surcouf patent discloses a propulsion system for airships in which a pair of engines, one having substantially more power than the other, are coupled to a pair of propeller shafts in such a manner that the engines can simultaneously drive both propellers, either engine can drive either one of the propellers, or either engine can drive both propellers. The Surcouf patent does not teach the athwartships shaft, transmission and clutch arrangement of the present invention, and in the invention it is not desired to have the two engines in operation simultaneously. Other prior art patents developed in a preliminary search are U.S. Pat. Nos. 1,781,656; 1,802,931; 2,501,617 and 3,155,070.

SUMMARY OF THE INVENTION

The marine propulsion system of the present invention includes two engines, one of which has substantially more power than the other, positioned in line with one another on the center line of the boat. There are also twin propellers and shafts, the shafts being parallel to the center line of the boat and on either side of the in line engines. Either engine (but not both) can be made to drive the twin propellers. The two engines oppose one another with their drive shafts extending into a common transmission assembly.

A double acting clutch in the transmission assembly permits either one of the engine drive shafts to be drivingly connected to an athwartships shaft the ends of which are respectively connected through transmission gear case units to the propeller shafts. Each gear case unit includes forward and reverse bevel gear impellers and a clutch that is movable from a neutral position into engagement with either one of the impellers.

With the propulsion system of the invention, the more powerful engine can be used for high speed cruising or when severe weather conditions dictate and the less powerful engine can be used for slow speeds and economical long distance cruising. Operation in this manner results in a substantial saving in fuel first because only one engine is operating at a time and second because the engine in use can operate at speeds that are in or near its own high efficiency range. In the event of a failure of one engine, a fully operational second system is available with twin propellers giving full maneuverability. When one of the engines in a conventional side by side twin engine system fails, the propeller for the remaining engine is off center making the boat difficult to maneuver.

The propulsion system disclosed herein requires less engine maintenance because with each engine operating at or near its most efficient speed there is less engine fouling, carbonization, etc. Also, the in line engine arrangement results in better load distribution in the boat and a lower center of gravity. With an in line engine arrangement, moreover, there is more room at the sides of the engines making them more easily accessible for maintenance and repairs.

DESCRIPTION OF THE PREFERRED EMBODIMENT

Figure 1:
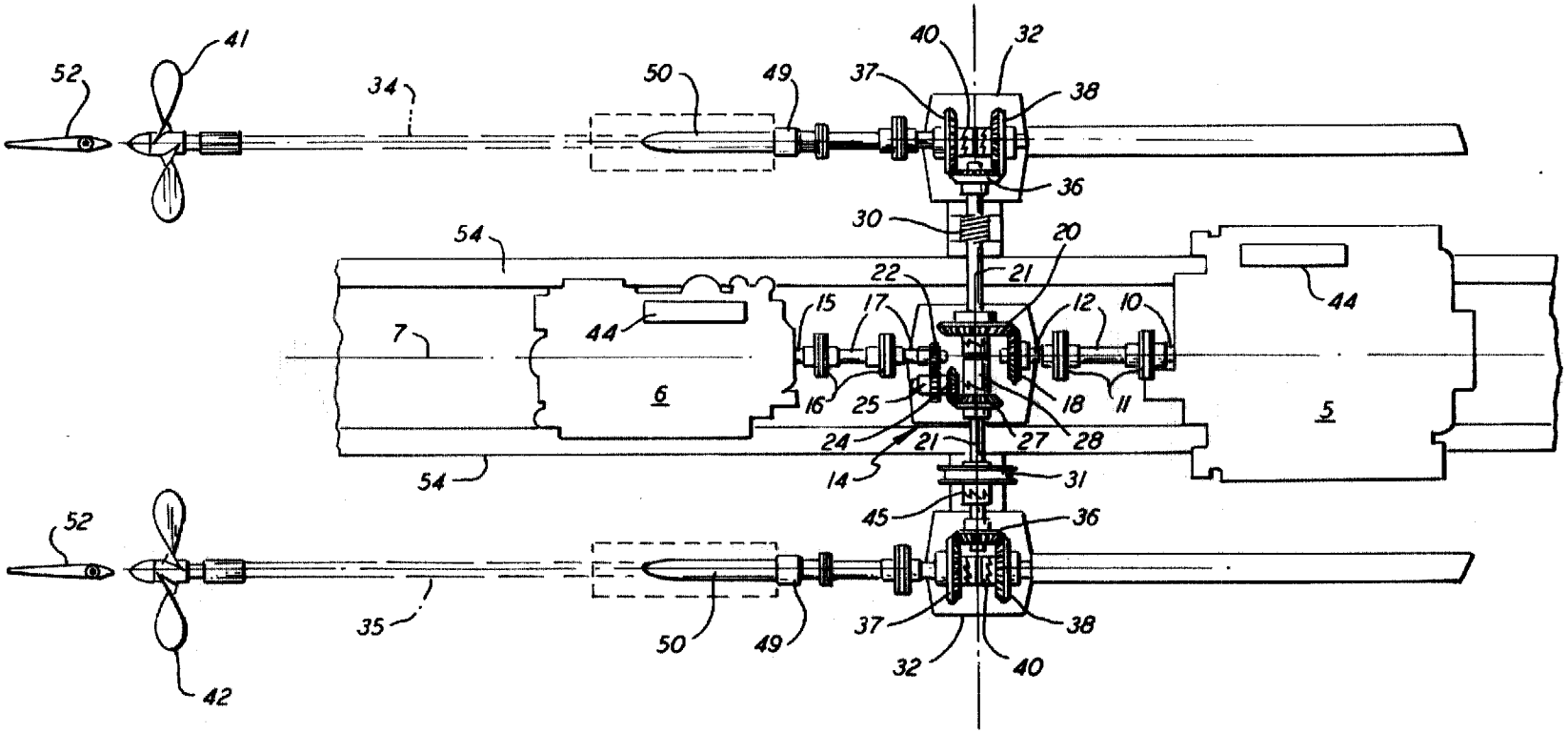
FIG. 1 is a diagrammatic top plan view of a marine propulsion system embodying the present invention.

Referring now to the drawings, the reference number 5 indicates the main or primary engine and 6 indicates the secondary engine. As best shown in FIG. 1, the two engines are centered on the center line 7 of the boat 8, FIG. 2, in spaced relation to one another. The engines can be gas or Diesel and it is also contemplated that the secondary engine 6 can be a power generator. Accordingly, the term "secondary engine" is intended to include the generator alternative in the description of this invention. Preferably, the main engine will have three to four times the power of the secondary engine and in the embodiment disclosed by way of example, the main engine is a 430 H.P. Diesel and the secondary engine is a 140 H.P. Diesel.

Neither engine 5,6 is equipped with a standard transmission. The output or drive shaft 10, FIG. 3, of main engine 5 is connected through flexible couplings 11 and stub shafts 12 to a main transmission assembly generally indicated at 14. Similarly, drive shaft 15 of engine 6 is connected to the transmission assembly through flexible couplings 16 and stub shafts 17. The outer shaft 12 for the main engine has mounted thereon, within the transmission assembly, a main engine input bevel gear 18, the shaft and gear having suitable bearing support. Though not shown in the drawings, all of the gears are preferably spiral bevel gears for strength and quiet operation.

Main engine input gear 18 meshes with a main engine impeller bevel gear 20 which is freely rotatable on an athwartships or cross shaft 21 that passes through the transmission assembly 14 at substantially right angles to the boat center line 7 as indicated in FIG. 1. Within the transmission assembly, the outer shaft 17 for the secondary engine carries a suitably journalled input straight gear 22 which meshes with gear 24 on an idler shaft 25. Shaft 25 also carries a bevel gear 26, FIG. 3, that meshes with the secondary engine impeller bevel gear 27, the latter also being freely rotatable on the cross shaft 21. As will be understood, various reduction ratios can be attained by varying the size and arrangement of the straight gears 22 and 24.

As is diagrammatically illustrated, a double acting clutch 28 is mounted on cross shaft 21 between the impeller bevel gears 20 and 27, the shift linkage for the clutch being conventional and being omitted for clarity. Clutch 28 is keyed or splined to shaft 21 so that it cannot rotate relative thereto but can move axially on the shaft from a neutral position into engagement with either impeller gear 20 or 27. With this arrangement, the drive shaft from either the main engine 5 or secondary engine 6 can be drivingly connected to the cross shaft 21 but, as will be apparent, both engines cannot be simultaneously connected to drive the shaft. Clutch 28 is preferably a dog clutch because of its positive action but other types of clutches can also be employed.

The cross shaft 21 passes through an oil pump 30 and a power take off unit 31, both to be described, and terminates at its outer ends in port and starboard transmission gear case units 32. These units serve to connect the cross shaft 21 with the port and starboard propeller shafts 34,35 and to evenly divide the output of the engine in use between them. Since the gear case units 32 are identical only one need be described.

Within the gear case unit 32, the end of the cross shaft 21 carries a suitably journalled cross shaft input bevel gear 36 that meshes with forward and reverse bevel gear impellers 37 and 38, respectively. Gears 37,38 are freely rotatable on the propeller shaft and between them a clutch 40 is mounted on the shaft, clutch 40 being similar to clutch 28 in the main transmission assembly. Thus, the clutch is keyed or splined to the propeller shaft so that it cannot rotate relative thereto but can move axially on the shaft from a neutral position into engagement with either the forward or reverse gear 37 or 38. The shift linkages (not shown) for the port and starboard clutches 40 are separate so that even though equal power is delivered to the gear case units 32, the propellers 41,42 can be independently controlled. Thus both can be driving forward, both can be in reverse, one can be driving in either direction and the other idling, and one can be driving forward and the other in reverse (as, for example, to "twist" the boat).

Figure 3:
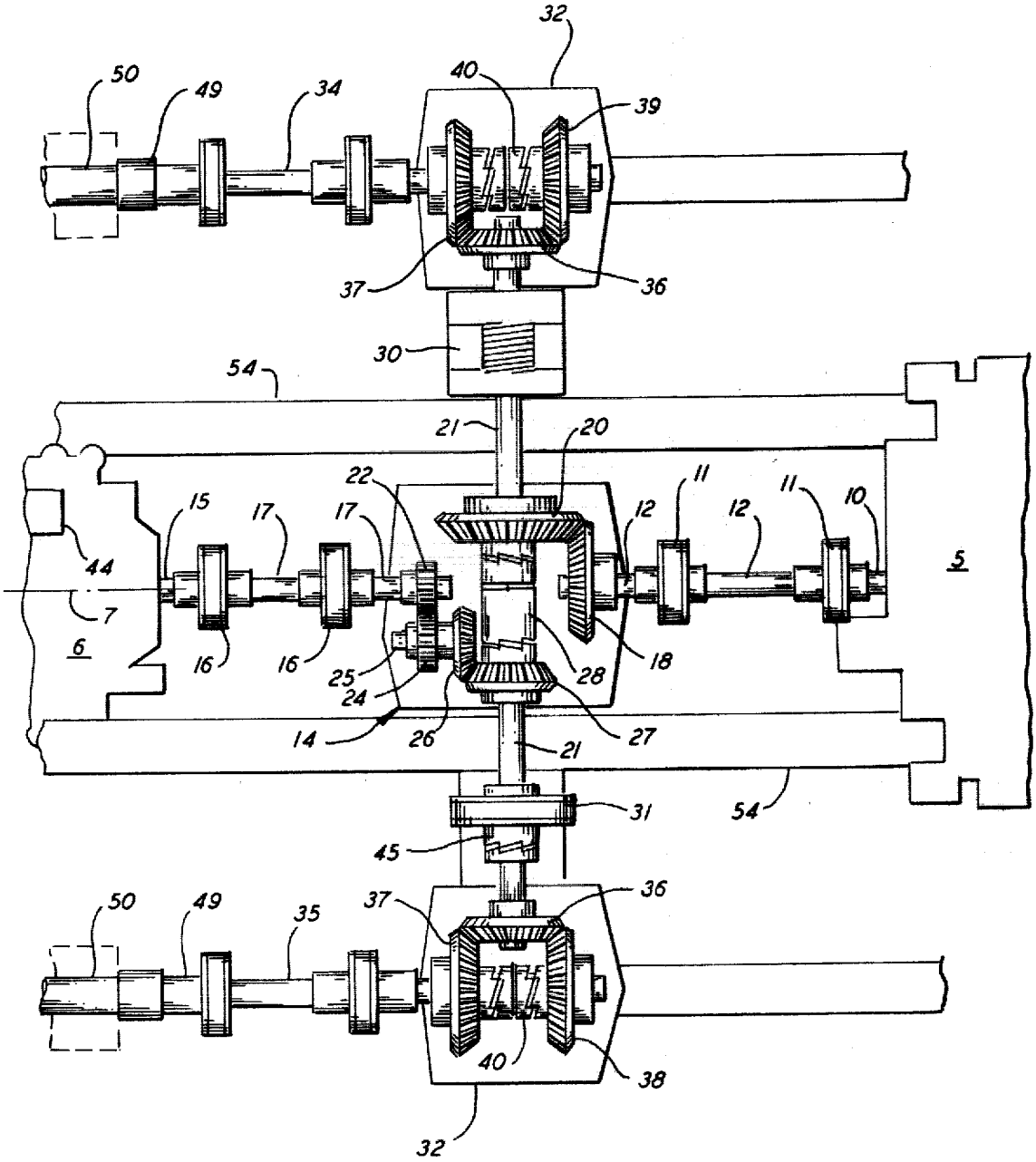
FIG. 3 is an enlarged diagrammatic plan view corresponding to FIG. 1, the view showing in more detail the main transmission assembly and the transmission gear case units.

The oil pump 30, FIGS. 1 and 3, referred to above is preferably a helical gear pump and operates to circulate the transmission oil between all engine gear boxes and engine oil coolers. The lubrication distributing system has been omitted for clarity. Each engine is provided with an oversized transmission oil cooler 44, FIG. 1, which is a heat exchanger that is added to standard engines to cool the oil sufficiently for all gear cases. The power take-off 31 is an optional feature and includes a suitable clutch 45 for engaging it with and disengaging it from cross shaft 21. The power take-off can be connected through any suitable drive means to auxiliary equipment.

Figure 2:
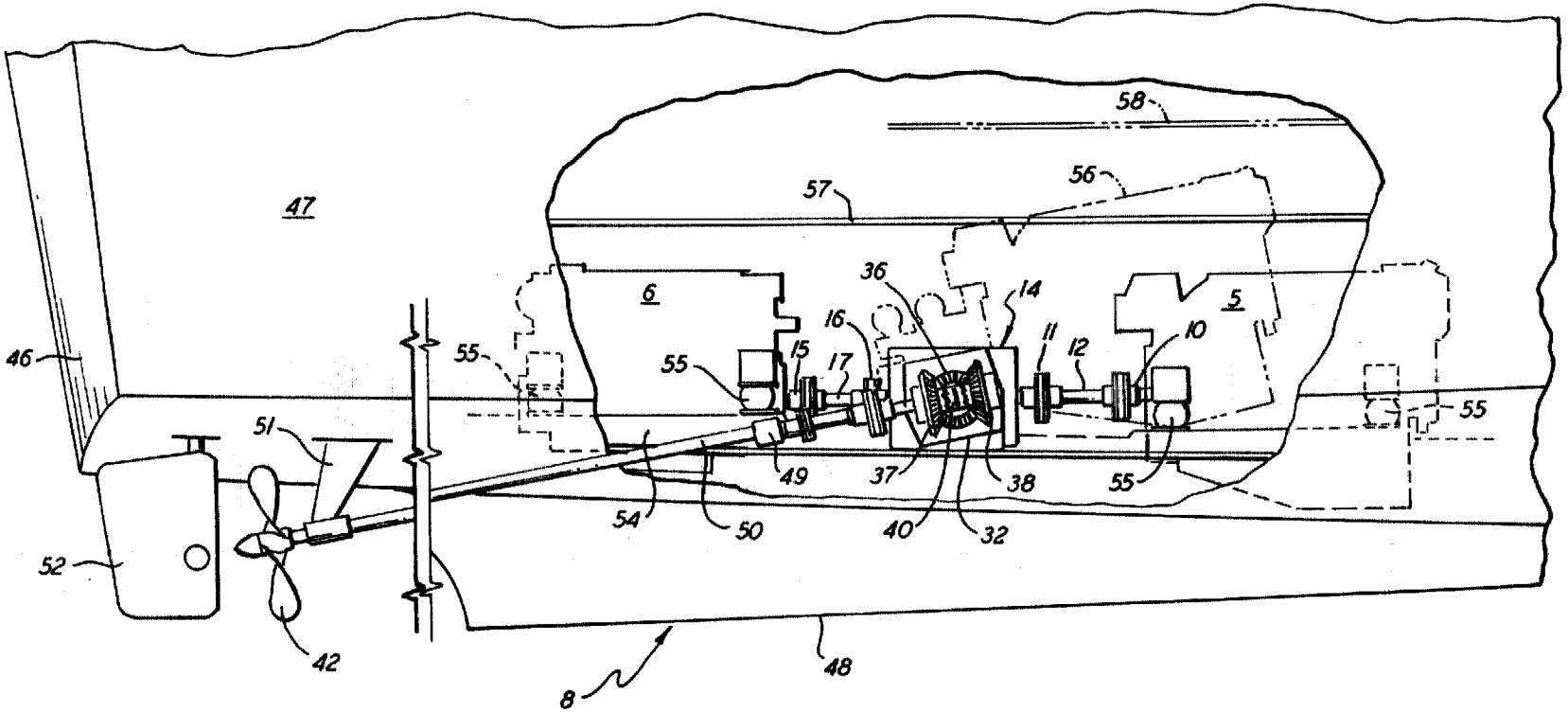
FIG. 2 is a fragmentary side elevation of a boat having the propulsion system, a portion of the side of the boat being broken away to show how the system is mounted therein.

FIG. 2 illustrates fragmentarily a cruising boat 8 in which the above described propulsion system is utilized. As used herein, the term "cruising boat" is intended to mean a pleasure craft rather than a commercial vessel and generally a boat less than 100 feet overall. The boat 8 has the usual transom 46, hull side 47 and keel 48. Where the propeller shafts 34,35 pass through the hull of the boat there are conventional stuffing boxes 49 with packing and shaft logs 50. The propeller shafts are supported adjacent their propellers 41,42 by struts 51 having suitable bearings. Aft of the propellers are twin rudders 52, FIGS. 1 and 2, of conventional design.

Within the boat 8, engines 5 and 6 are supported by stringers 54, FIG. 1, which comprise the engine supporting frame. The engines may have "soft engine mounts" 55, FIG. 2, of a known type between them and the stringers as shown. When soft engine mounts are employed, the flexible couplings 11 and 16 are advisable.

As best shown in FIG. 2, the main transmission assembly 14 and its in line arrangement with the main and secondary engines enables the latter to be mounted so that they are substantially horizontal rather than at an angle as shown in dash lines at 56, the phantom lines representing the engine in a conventional installation wherein the engine must be mounted at the same angle as the propeller shaft. The engine mounting of the invention has the obvious advantage that the level of the cabin sole or floor, indicated at 57, can be substantially lower than the level of the cabin sole in a conventional engine mounting as shown by phantom lines at 58. The lowering of the sole permits the cabin to be built with more head room.

The in line arrangement of the engines 5 and 6 results in better load distribution in the boat and a lower center of gravity. Also, with an in line arrangement there is more room at the sides of the engines making them more easily accessible for maintenance and repairs.

As noted above, the secondary engine could be a power generator in which case it would only be used in an emergency as, for example, to get back to port. Use of a power generator would require additional gear reduction.

The helm controls for the propulsion system of the invention consist of the usual start, stop and throttle controls for each engine, and the gear shift control for the port and starboard propellers (neutral, forward and reverse). In addition, there is a shift control (not shown)

for the main transmission clutch 28 that determines which engine 5 or 6 will be operably engaged with the transmission. In operation, when running on one engine and desiring to switch to the other, the inoperative engine is started while the other engine is still running and then, with both engines idling, the shift control for clutch 28 is moved to the disengaged position and then into the engaged position for the other engine. The first engine can then be switched off. In this way, the boat operator will not find himself without power if for any reason the other engine will not start.

From the foregoing description, it will be apparent that the invention provides a novel marine propulsion system having many advantages over conventional systems. As will be understood by those familiar with the art, the invention may be embodied in other specific forms without departing from the spirit or essential characteristics thereof.

I claim:

1. In a propulsion system for a cruising boat or the like, a primary operating engine and a secondary engine having less power than the primary engine, the primary and secondary engines being in line with one another substantially on the fore and aft center line of the boat, a main transmission assembly located between the two engines on said center line, the output shafts of the engines being operably connected to the transmission assembly, an athwartships shaft passing through the transmission assembly and extending outwardly therefrom toward the opposite sides of the boat, a transmission gear case unit operably connected to each end of the athwartships shaft, a pair of laterally spaced propeller shafts disposed in substantially parallel relation to the fore and aft center line of the boat, the inboard end of each propeller shaft being respectively operably connected to one of the transmission gear cases, a double acting clutch in the main transmission assembly for connecting either the primary or secondary engine output shaft to the athwartships shaft, and clutch means in each transmission gear case operable to drivingly connect its propeller shaft to the athwartships shaft.

2. A propulsion system as defined in claim 1 wherein the athwartships shaft is disposed at substantially right angles to the fore and aft center line of the boat.

3. A propulsion system as defined in claim 1 wherein the primary and secondary engines are mounted in substantially horizontal positions when the boat is at rest in the water.

4. A propulsion system as defined in claim 1 wherein each transmission gear case includes forward and reverse bevel gear impellers, the clutch means in each case being movable from a neutral position into engagement with either one of the impellers.

5. In a propulsion system for a cruising boat or the like, a primary operating engine and a secondary engine having substantially less power than the primary engine, the primary and secondary engines being in line with one another substantially on the fore and aft center line of the boat, a main transmission assembly located between the two engines, the drive shaft of each engine being operably connected to an impeller gear in the transmission assembly, the drive shaft for the secondary engine being connected to its impeller gear through reduction gears, an athwartships shaft passing through the transmission assembly at substantially right angles to the boat fore and aft center line and extending outwardly from the assembly toward the opposite sides of the boat, a double acting clutch in the transmission assembly operable to drivingly connect either one of said impeller gears to the athwartships shaft, a transmission gear case unit operably connected to each end of the athwartships shaft, the gear case units being spaced laterally from the transmission assembly, a pair of spaced propeller shafts disposed in substantially parallel relation to the fore and aft center line of the boat whereby the shafts are perpendicular to the athwartships shaft, the inboard end of each propeller shaft being operably connected to one of the transmission gear cases, and clutch means in each gear case for drivingly connecting the athwartships shaft to the propeller shaft connected to the case.

6. A propulsion system as defined in claim 5 wherein the primary and secondary engines are mounted in substantially horizontal positions when the boat is at rest in the water.

7. A propulsion system as defined in claim 5 wherein each transmission gear case includes forward and reverse bevel gear impellers, the clutch means in each case being movable from a neutral position into engagement with either one of the impellers.

8. A propulsion system as defined in claim 7 wherein said forward and reverse bevel gear impellers are rotatably mounted on the propeller shaft for each transmission gear case, each case including an input bevel gear fixed on the end of the athwartships shaft and engaging the forward and reverse gear impellers.

* * * * *